US005553645A

United States Patent [19]

Durney

[11] Patent Number: 5,553,645

[45] Date of Patent: Sep. 10, 1996

[54] DRILLING AND COUNTERBORING APPARATUS AND METHOD FOR FORMING SCREW POCKETS

[75] Inventor: Max W. Durney, Penngrove, Calif.

[73] Assignee: Castle Tool Machinery, Incorporated, Petaluma, Calif.

[21] Appl. No.: 401,952

[22] Filed: Mar. 10, 1995

[51] Int. Cl.[6] ..... B27M 1/08; B27C 1/00

[52] U.S. Cl. ..... 144/365; 29/26 A; 408/26; 409/199; 144/134.1

[58] Field of Search ..... 408/1 R, 24, 25, 408/26, 36, 136; 409/199; 29/26 A, 26 B; 144/365, 367

[56] References Cited

U.S. PATENT DOCUMENTS

| | | | |
|---|---|---|---|
| 1,335,544 | 3/1920 | Anders . | |
| 1,602,658 | 10/1926 | Germain . | |
| 3,348,248 | 10/1967 | Milkert | 408/1 |
| 3,447,454 | 6/1969 | Ratz | 408/136 X |
| 3,496,974 | 2/1970 | Munsil et al. . | |
| 3,675,312 | 7/1972 | Herman . | |
| 4,545,707 | 10/1985 | Bradley, Jr. et al. | 408/136 X |
| 4,603,719 | 8/1986 | Durney . | |
| 5,063,982 | 11/1991 | Durney | 408/26 X |
| 5,340,247 | 8/1994 | Cuneo et al. | 29/26 A |

*Primary Examiner*—M. Rachuba
*Assistant Examiner*—Henry Tsai
*Attorney, Agent, or Firm*—Flehr, Hohbach Test Albritton & Herbert

[57] ABSTRACT

An apparatus (30) and method for forming an obliquely oriented counterbore (17) in a surface (15) of a workpiece (13) and a fastener receiving passage (19) proximate an edge (32) of the workpiece (13). The apparatus (30) includes a support frame (33), and a router assembly (34). The router assembly (34) is mounted for arcuate movement between a stored position, out of contact with the workpiece (13), and a routing position where a router bit (36) contacts the workpiece (13) to cut a tapering recess (1.7). A drill assembly (39) is movably mounted to the frame (33) for linear movement between a recessed position, out of contact with the workpiece (13), and a drilling position. In the drilling position, a drill bit (41) engages the workpiece (13) in a direction generally opposing the router bit (36) to drill the passage (19). A biasing assembly (43) is included independently biasing the router assembly (34) and the drill assembly (39) in generally opposite directions toward the stored position and the recessed position, respectively, to maintain the router bit (36) and the drill bit (41) out of engaging contact with one another.

28 Claims, 7 Drawing Sheets

DRILLING AND COUNTERBORING APPARATUS AND METHOD FOR FORMING SCREW POCKETS

TECHNICAL FIELD

The present invention relates, generally, to drilling and counterboring apparatus and, more particularly, relates to apparatus suitable for forming obliquely oriented counterbores and fastener receiving bores for screw pockets to fasten two members together.

BACKGROUND ART

There are many applications in joinery in which two members must be secured together by fasteners in such a way that the fastening elements are not visible from the outside surfaces of the resulting structure. In U.S. Pat. No. 3,496,974, for example, a stepped drill bit is disclosed which is suitable for forming a counterbore and fastener receiving bore in the back side of a wooden member proximate the edge thereof to permit the formation of a face frame. The counterbore and the screw receiving bore are both formed at a relatively shallow angle (or oblique angle if measured from the drill axis in the direction of advancement of the drill) with respect to the back surface of the member being drilled proximate an edge thereof. A screw positioned in the screw receiving bore hole and extends outwardly of the edge of the member to permit threading of the screw into a second member. As shown in U.S. Pat. No. 3,496,974, the members are oriented in substantially the same plane and joined together in abutting relation. It is also possible to use this same screw pocket fastening approach to join one member in a perpendicular orientation to another member.

U.S. Pat. No. 3,675,312 discloses an alternative apparatus and process for joining together two members in perpendicular relation to each other. This approach also employs an obliquely oriented tool access hole and a large counterbore which is drilled into the edge of the member which will carry the screw. An annular insert is then adhesively secured in the counterbore with the screw in the central bore of the insert, and the access opening is used to drive the screw into the second member.

It is very difficult to drill a counterbore at a shallow or oblique angle with respect to a workpiece since the drill will tend to wander. More particularly, however, it will be deflect toward a parallel orientation with the surface as it enters. The bore that is cut is very often ragged and characterized by chipping. For particle board and hardboard, as well as very hard lumber, drilling at a shallow angle, even with jigs or fixtures, is almost impossible. Similarly, for plastics having low friction surfaces it is extremely difficult to start a stepped drill having a configuration as shown in U.S. Pat. No. 3,496,974.

The approach shown in U.S. Pat. No. 3,675,312 has the disadvantage of requiring a separate insert piece which must be secured by a separate process, as well as a specialized tool. Moreover, the time required to form a joint is undesirably long. Other even more complex face-framing apparatus can be seen in U.S. Pat. Nos. 1,335,544 and 1,602,658.

A better approach is shown in U.S. Pat. No. 4,603,719, as shown in FIG. 1, which discloses a router assembly 10 and an opposed drill assembly 11 both rigidly mounted to a common carriage 12 which is either slidably or pivotally reciprocated. This enables sequential engagement of a workpiece 13 by the router assembly and the drill assembly from opposed directions to form a screw pocket 14 shown in FIG. 2.

Because router assembly 10 is formed to progressively engage surface 15 of workpiece 13 at a relatively shallow oblique angle, a large lateral force must be applied on router bit 16 to enable it to accurately and effectively cut the tapered recess or counterbore 17. In the linear sliding carriage embodiment (not shown), this required lateral force is difficult to manually apply.

A more efficient arrangement to manual application of the router assembly is the pivotal carriage embodiment of FIG. 1. The pivot nature of the carriage furnishes the operator much more leverage to more easily apply the necessary lateral force on the router bit 16. This arrangement fixedly mounts router assembly 10 and drill assembly 11 to common carriage 12 which is pivotally mounted to casing 18 about pivotal axis 20. Upon sequential engagement of the router assembly 10 and drill assembly 11 with workpiece 13, screw pocket 14 is formed consisting of counterbore 17 and bore 19 communicating with the counterbore (FIG. 2).

One problem associated with this pivotal configuration is that to assure a relatively linear drilling path of drill bit 21 upon engagement with workpiece 13, the pivotal radius or pivotal arm (illustrated by broken line 22 in FIG. 1) of drill assembly must be relatively long. Too short a pivotal arm will detrimentally cause drill assembly 11 to move along too arcuate a path. This causes the drill bit 21 to engage the workpiece at too steep an angle which reduces the linearity of bore 19. Moreover, substantial lateral forces are induced on the drill bit which results in premature wear or breakage of the drill bit during operation.

However, a long pivotal arm 22 is disadvantageous as well because the overall height dimension of the apparatus must be proportionately tall to accommodate the height and pivotal motion of carriage 12. Since these screw pocket forming apparatuses are often portable in natured table top use is often precluded.

Another problem associated with this arrangement is that the long pivotal arm increases the collective arcuate motion of drill assembly 11 and router assembly 10 which in turn increases the depth dimension of the casing. Accordingly, the overall compactness of the apparatus is compromised, as well as increasing manufacturing costs.

DISCLOSURE OF INVENTION

Accordingly, it is an object of the present invention to provide an apparatus and method for forming an obliquely oriented counterbore and fastener receiving passage which is suitable for use in hard woods, particle board, hardboard and plastics, and laminated plastic and substrate products.

Another object of the present invention is to provide a counterbore and drilling apparatus incorporating a pivotally mounted router assembly of reduced height dimension.

Yet another object of the present invention is to provide a counterbore and drilling apparatus and method which reduces lateral forces applied to the drill assembly during operation.

Still another object of the present invention is to provide a counterbore and drilling apparatus and method which biases a router assembly and a drilling assembly out of contact with the workpiece.

It is a further object of the present invention to provide a counterbore and drilling apparatus and method which is durable, compact, easy to maintain, has a minimum number of components, and is easy to use by unskilled personnel.

In accordance with the foregoing objects, the present invention an apparatus for forming an obliquely oriented counterbore in a surface of a workpiece and a fastener receiving passage proximate an edge of the workpiece. The apparatus includes a support frame, and a router assembly having a router bit. The router assembly is movably mounted to the frame and oriented with the router bit rotational axis generally perpendicular to the direction of motion of the router assembly. Further the router assembly is mounted for arcuate movement between a stored position, out of contact with the workpiece, and a routing position. In the routing position, the router bit contacts the workpiece along a progressively inwardly path to cut a tapering recess in the surface which terminates in a shoulder transverse to the surface proximate and in spaced relation to the edge to form the obliquely oriented counterbore. The apparatus of the present invention further includes a drill assembly having a drill bit, and is movably mounted to the frame. The drill assembly is oriented with the drill bit rotational axis generally perpendicular to the router bit rotation axis when the router bit is situated in the routing position. Further, the drill assembly is mounted for linear movement between a recessed position, out of contact with the workpiece, and a drilling position. In the drilling position, the drill bit engages the workpiece in a direction generally opposing the router bit to drill the passage from the edge into the workpiece a sufficient distance causing the passage to communicate with the counterbore. A biasing assembly is included independently biasing the router assembly and the drill assembly in generally opposite directions toward the stored position and the recessed position, respectively, to maintain the router bit and the drill bit out of engaging contact with one another.

A method for forming an obliquely oriented counterbore in a surface proximate an edge of a workpiece and a connecting fastener receiving passage between the counterbore and the edge. The method includes the steps of: advancing a router assembly from a stored position, out of contact with the workpiece, to a routing position, contacting the workpiece with a router bit along a path to progressively cut an inwardly tapering counterbore in the surface terminating in a transverse shoulder; and advancing a drill assembly from a recessed position, out of contact with the workpiece, to a drilling position, contacting the workpiece from the edge inwardly until the passage extends to a position which will communicate with the counterbore. The method further includes the step of independently biasing the router assembly and the drill assembly in generally opposite directions toward the stored position and the recessed position, respectively, to maintain the router bit and the drill bit out of engaging contact with one another.

BRIEF DESCRIPTION OF THE DRAWING

The assembly of the present invention has other objects and features of advantage which will be more readily apparent from the following description of the best mode of carrying out the invention and the appended claims, when taken in conjunction with the accompanying drawing, in which:

BEST MODE OF CARRYING OUT THE INVENTION

Figure 1:
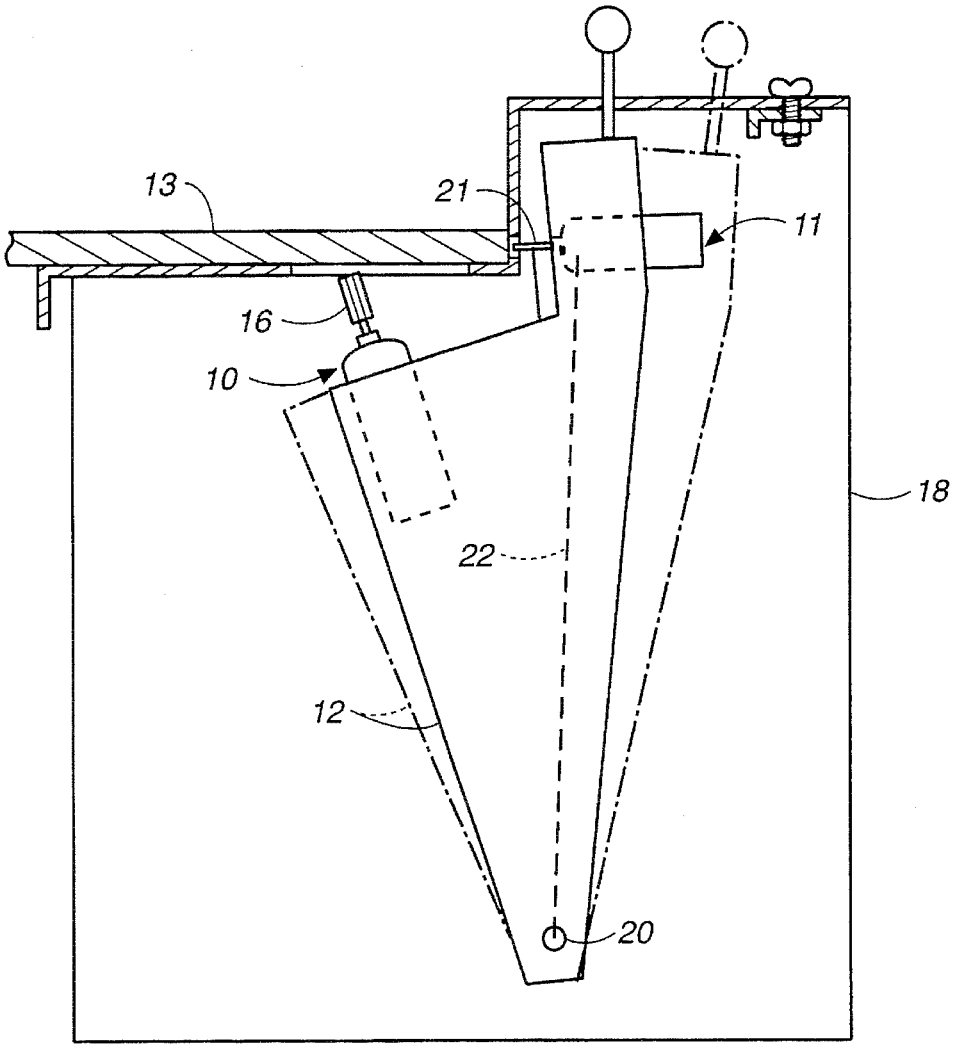
FIG. 1 is a side elevation view, in cross-section, of a conventional screw pocket joining two individual pieces together.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 3:
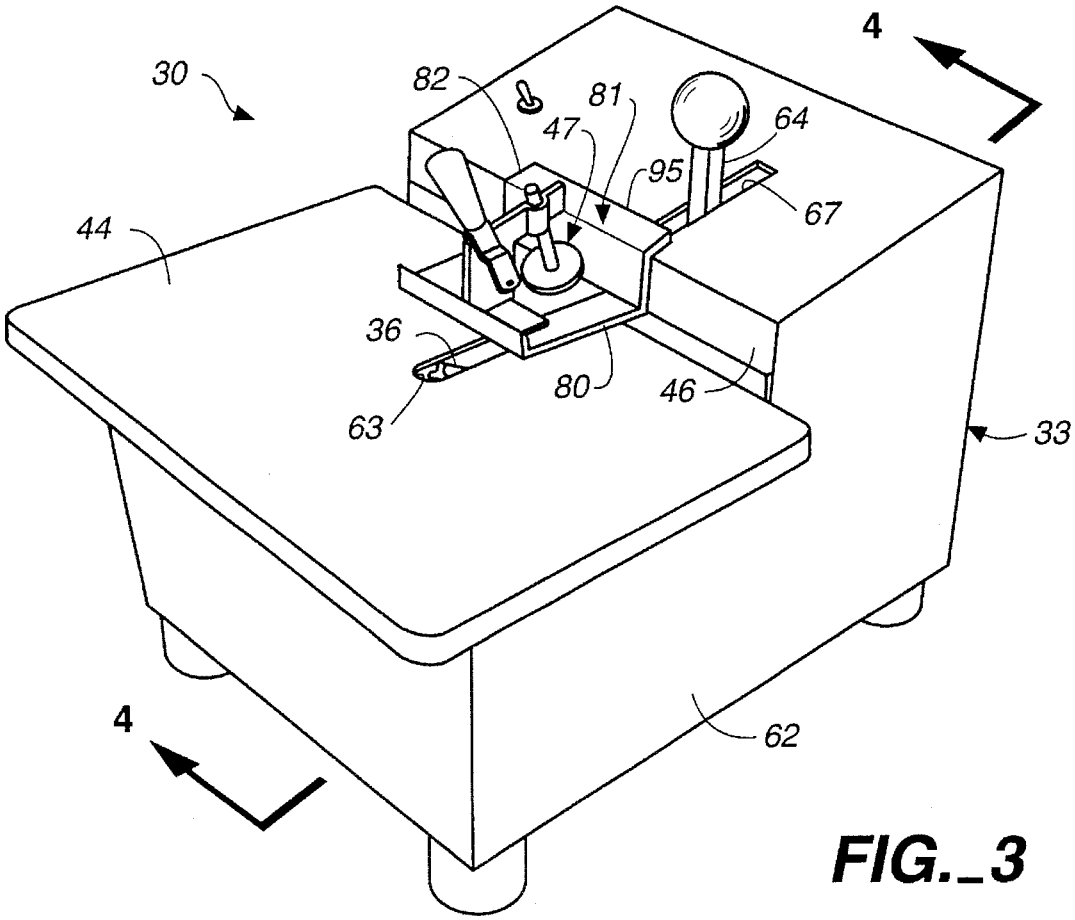
FIG. 3 is a top perspective view of a counterboring and drilling apparatus constructed in accordance with the present invention.
Figure 4:
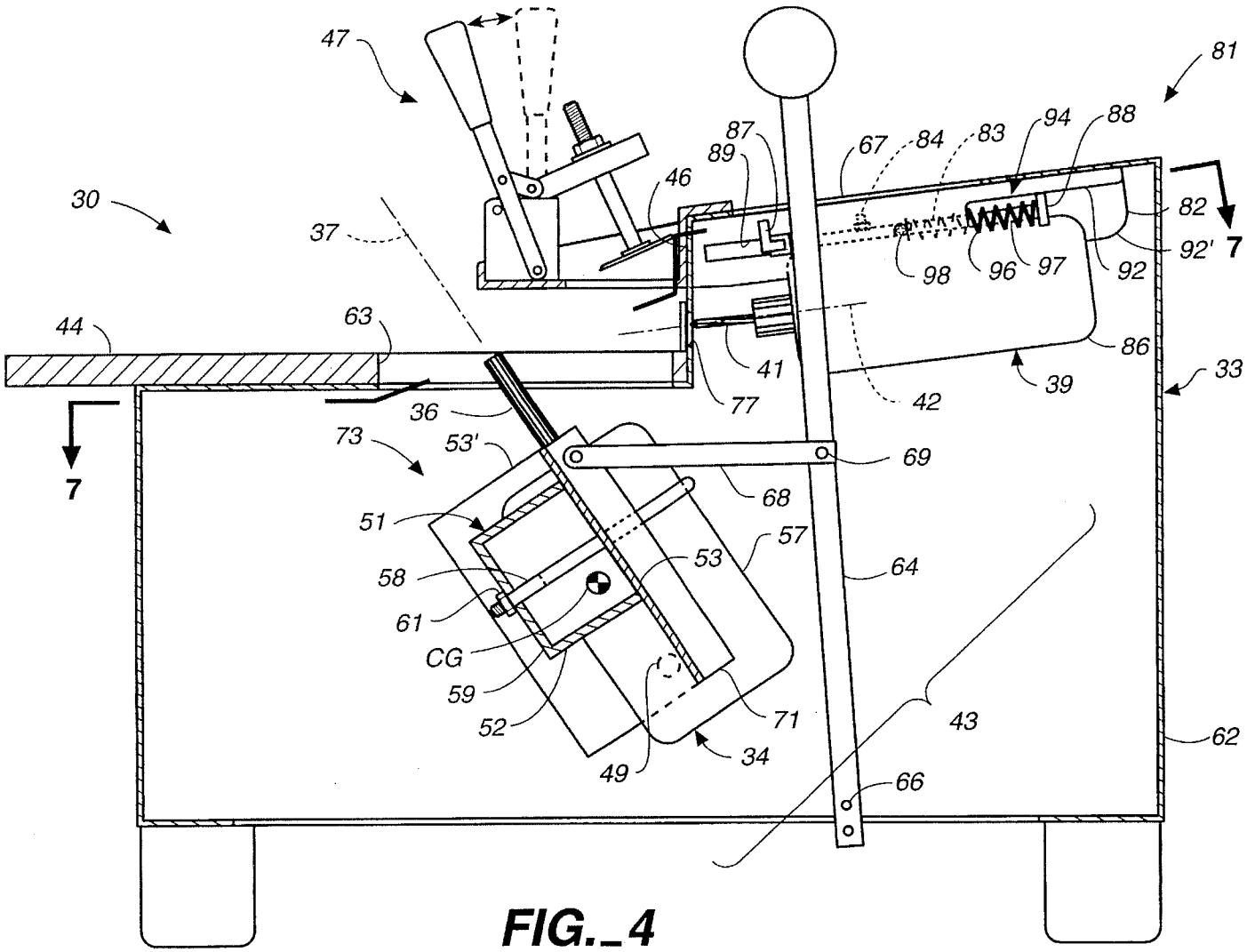
FIG. 4 is an enlarged side elevation view, in cross-section, of the apparatus taken substantially along the plane of line 4—4 in FIG. 3, and illustrating the apparatus in a neutral position with a router assembly in a stored position, and a drilling assembly in a recessed position.
Figure 5:
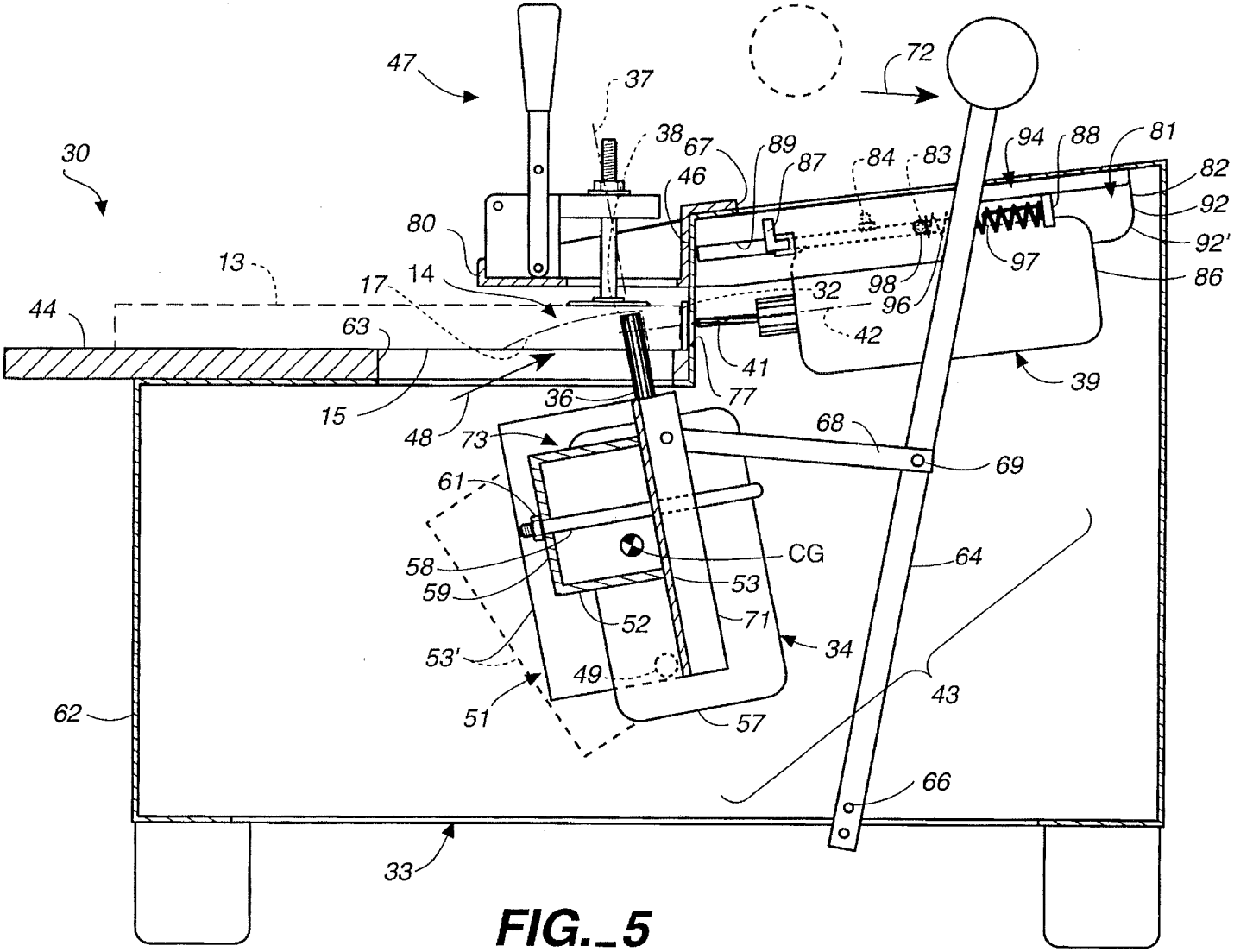
FIG. 5 is a side elevation view, in cross-section, of the apparatus of FIG. 4 illustrating the router assembly in a routing position.

Attention is now directed to FIGS. 3 through 6 where the counterbore and fastener bore forming apparatus, generally designated 30, of the present invention is illustrated for description in detail. As mentioned, apparatus 30 forms the screw pocket 14 (FIG. 2) having the obliquely oriented counterbore 17 in surface 15 of workpiece 13 and a fastener receiving passage 19 proximate an edge 32 of the workpiece. Apparatus 30 includes a support frame 33, and a router assembly, generally designated 34, having a router bit 36. Router assembly 34 is movably mounted to frame 33 and oriented with the router bit rotational axis 37 generally perpendicular to the direction of motion (arrow 48 in FIG. 5) of the router assembly. Further the router assembly is mounted for arcuate movement between a stored position (FIGS. 4 and 6), out of contact with workpiece 13, and a routing position (FIG. 5). In the routing position, router bit 36 contacts workpiece 13 along a progressively inwardly path to cut a tapering recess (counterbore 17 in FIG. 2) in surface 15 which terminates in a shoulder 38 transverse to the surface proximate and in spaced relation to edge 32 to form the obliquely oriented counterbore.

Figure 6:
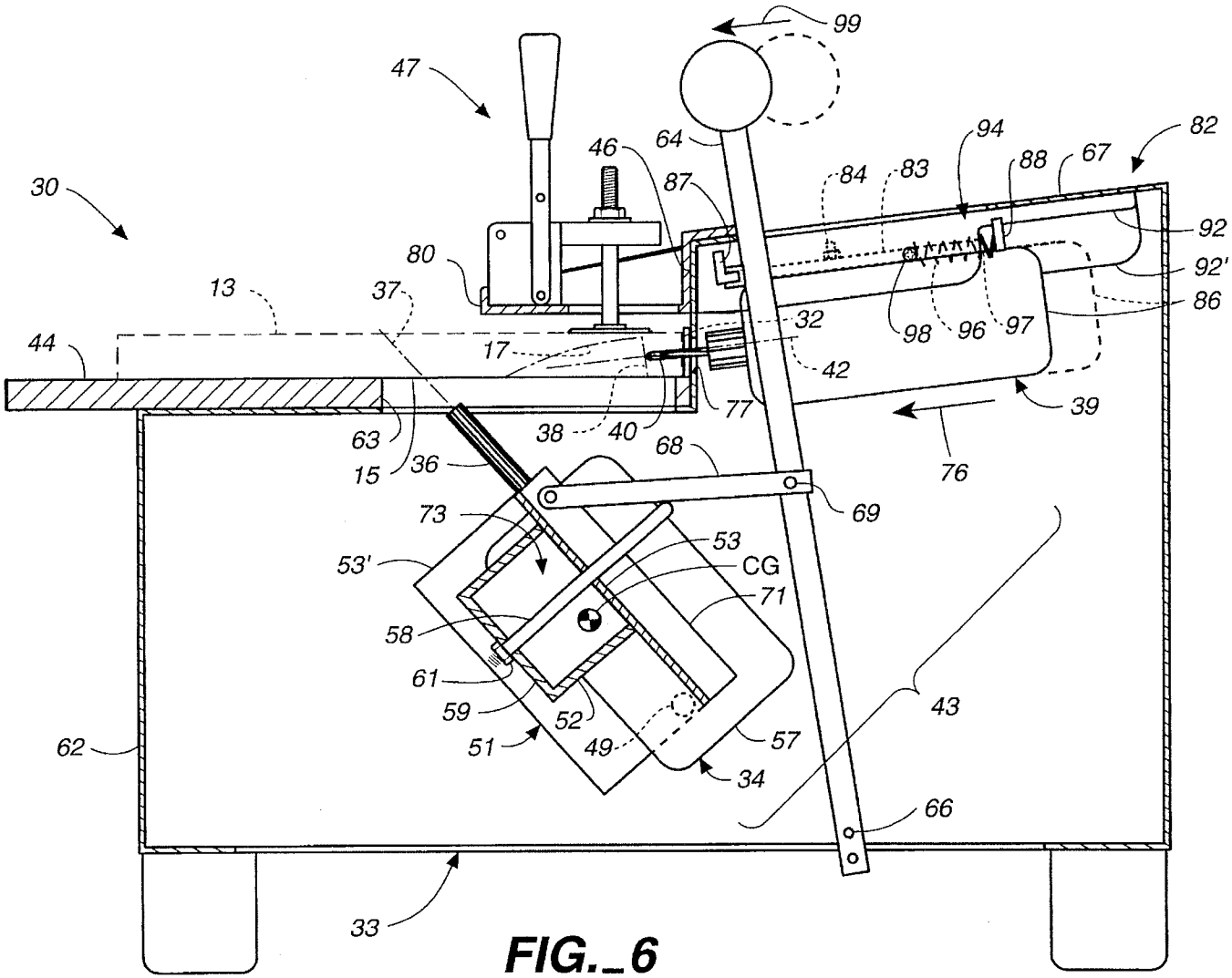
FIG. 6 is a side elevation view, in cross-section, of the apparatus of FIG. 4 illustrating the drilling assembly in a drilling position.

Apparatus 30 further includes a drill assembly, generally designated 39, movably mounted to frame and including a drill bit 41. The drill assembly is oriented with the drill bit rotational axis 42 generally perpendicular to router bit rotational axis 37 when router bit 36 is situated in the routing position. Further, drill assembly 39 is mounted for linear movement between a recessed position (FIGS. 4 and 5), out of contact with workpiece 13, and a drilling position (FIG. 6). In the drilling position, drill bit 41 engages workpiece 13 in a direction (arrow 76 in FIG. 6) generally opposing router bit 36 to drill passage 19 from edge 32 into the workpiece a sufficient distance for communication of passage 19 with counterbore 17.

A biasing assembly, generally designated 43, is included independently biasing router assembly 34 and drill assembly 39 in generally opposite directions toward the stored position and the recessed position, respectively, to maintain router bit 36 and drill bit 41 out of engaging contact with one another.

Accordingly, the screw pocket forming apparatus of the present invention provides a drill assembly mounted to the frame for linear movement to contact the workpiece, and a router assembly which is independently mounted to the frame for pivotal movement for routing of the workpiece. Importantly, the drill bit engages the workpiece axially therealong which substantially eliminates any lateral forces adversely applied to the drill bit during drilling. Further, the pivotal movement of the router assembly is retained which facilitates leveraged operation of the router. The pivotal arm length of the router assembly, however, can be relatively short (i.e., no more than the length of the router assembly) which permits the overall height of the casing enclosing the components to be substantially reduced while still providing the operator enough leverage to apply the proper lateral force on the router bit. Moreover, since the drill assembly does not move along the arcuate path of the router assembly, substantially reducing relative displacement of the drill assembly, the depth of the casing can be minimized. These two dimension reductions enable the apparatus to be suitable for portable tabletop operation.

In addition, the biasing assembly promotes safety since both the router assembly and the drilling assembly are biased toward the stored position and the recessed position, respectively, when in nonuse.

FIG. 3 best illustrates that screw pocket forming apparatus 30 includes a support surface or table 44 formed for support of workpiece 13 in a position for formation of counterbore 17 and fastener receiving passage 19. Preferably, the table includes a step or shoulder portion 46 against which edge 32 of the workpiece (FIG. 5) can be abutted so as to allow the operator to locate the workpiece in a position for cutting. The workpiece should be clamped to table 44 by clamping device 47 to hold the work in indexed relation against shoulder 38.

Instead of attempting to drill at a shallow or oblique angle with respect to the workpiece surface 15, the apparatus of the present invention is formed to orient the counterbore forming bit transverse to surface 15. As may be seen in FIG. 5, the angle between the plane of entry of the router bit into workpiece 13 (i.e., the direction of arrow 48) and workpiece surface 15 is an "oblique" angle. The complimentary angle is also sometimes referred to as a "shallow" angle.

Figure 7:
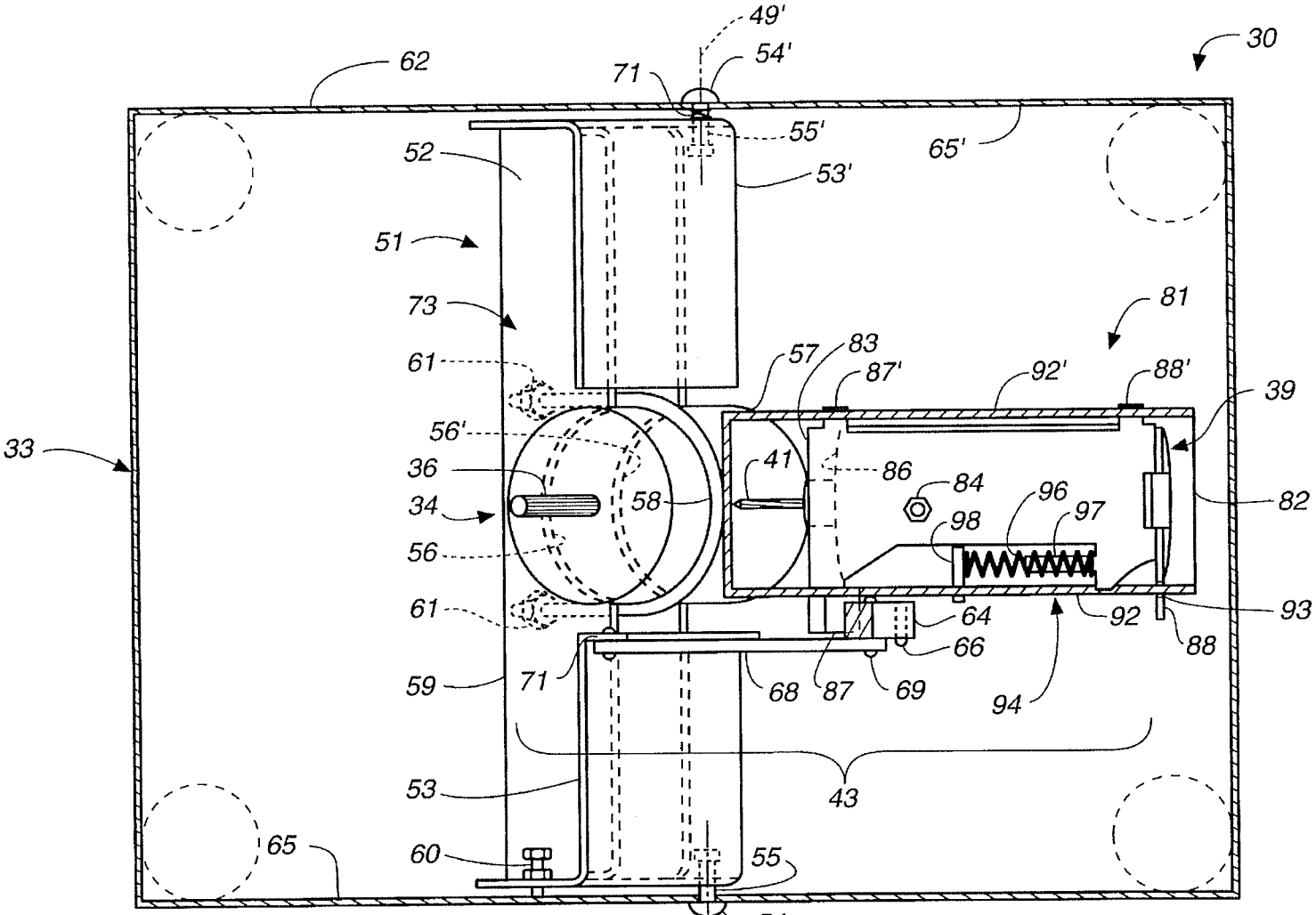
FIG. 7 is a top plan view, in cross-section, of the apparatus taken substantially along the line 7—7 in FIG. 4.

Pivotally mounted to support frame 33 about a router pivotal axis or point 49, 49' is a router support bracket 51 formed for releasable mounting of router assembly 34 thereto. Briefly, support bracket 51 includes an elongated C-shaped member 52 (FIGS. 4 and 7) having two opposing L-shaped members 53, 53' mounted to the opposing ends and around the open face of C-shaped member 52. FIG. 7 illustrates that the opposing L-shaped members 53, 53' are pivotally mounted to support frame 33 through opposing bolts 54, 54' which extend through pivot holes (not shown) in the corresponding L-shaped members 53, 53' which enable the router support bracket and the router assembly to pivot about router pivotal points 49, 49'.

C-shaped member 52 includes upper and lower semi-circular recesses 56, 56' formed and dimension for receipt of a portion of the periphery of cylindrical router body 57 of router assembly 34 therein. A U-shaped bolt 58 (FIG. 7) extends around the remaining periphery of router body 57 between upper and lower semi-circular recesses 56, 56' for releasable mounting of the router assembly to the support bracket. The ends of U-shaped bolt 58 extend through apertures in a back wall 59 of C-shaped member 52 which threadably mates with nuts 61 for retainment thereto.

It will be understood, however, that pivotal bolts 54, 54' and hence pivot points 49, 49', are to be positioned generally above a bottom portion of router body 57. Accordingly, the radius of the arcuate movement of router bit 36 of the present invention is relatively short as compared to the length of the pivotal arm in the prior art counter boring and drilling apparatus set forth in FIG. 1. Preferably, the radius of the arcuate movement of the router bit is to be no more than the length of the total height of router assembly 34 from the router body bottom to the distal end of router bit 36. In fact, in the most preferred embodiment, as shown in FIGS. 4–6, the length of the arcuate arm is less than the length of the total height of the router assembly.

In the preferred embodiment of the present invention, an adjustment screw 60 (FIG. 7) is provided for adjusting router support bracket 51 laterally from side-to-side relative frame 33 and casing 62. This adjustment enables alignment of the counterbore with the passage. Further, bolts 54, 54' include sleeve portions 55, 55' covering the threaded portion of the bolts. Each sleeve portion 55, 55' has a smooth outer peripheral surface formed for sliding and rotating receipt in the corresponding pivot holes of the L-shaped members which enable support bracket 51 to slide axially along the bolts.

Adjustment screw 60 is preferably threadably mounted to a side portion of L-shaped member 53 which includes a threaded aperture (not shown). As screw 60 engages the threaded aperture, a distal end thereof abuts or contacts the inside wall 65 of casing 62. Continued threaded engagement of screw 60 with the threaded aperture causes router support bracket 51 to move axially along sleeve portions 55, 55', and laterally and away from inside wall 65 of casing 62. After alignment, a locking nut 70 locks screw 60 relative L-shaped member 53.

Accordingly, the distal end of adjustment screw 60 slidably contacts inside wall 65 during pivotal motion of the support bracket between the stored and routing position. This continual contact of the screw with the casing wall transfers and distributes lateral compression forces from the router cutting action to the casing.

A biasing spring 74, positioned between the opposing casing inside wall 65' and L-shaped member 53', biases the router support bracket 51 toward the inside wall 65.

The present invention, therefore, enables a much shorter lever stroke and pivotal stroke of the router support bracket which results in a more efficient and effective frame 33 and casing 62 enclosing the router assembly and router support bracket 51. Ultimately, the height is more conducive to tabletop operation, storage and transport of the apparatus.

Referring back to FIGS. 4–6, router assembly 34 includes a cutting or router bit 36 having an axis of rotation 37 generally perpendicular to the direction of motion (arrow 48) of the router assembly between the stored position (FIGS. 4 and 6), out of contact with workpiece 13, and the routing position (FIG. 5), contacting the workpiece along the progressively inwardly path to cut tapered recess 17. Accordingly, as router support bracket 51 is pivoted about pivot points 49, 49', therefore, router assembly 34 is swung up through a slot 63 in table 44 into engagement with surface 15 of the workpiece. As will be seen in FIG. 5, router bit 36 progressively is moved toward and into the workpiece to cut an inwardly tapered, slightly curved recess 17 in surface 15 proximate edge 32 of the workpiece. The result is a leveraged machining action in which router bit 36 is able to gradually enter workpiece 13 at angle without chipping the workpiece and without wandering or being deflected by the shallow angle of recess 17. Thus, instead of trying to form counterbore 17 with a tool that rotates with an axis virtually parallel to workpiece surface 15 (for example as is required with the apparatus of U.S. Pat. No. 3,496,974), the axis of router bit 36 is transverse and almost perpendicular to surface 15 permitting it to progressively enter the surface at an oblique angle. The arcuate motion of support bracket 51 produces an arcuate recess 17, which has the desirable effect of shortening the length of the recess.

Figure 2:
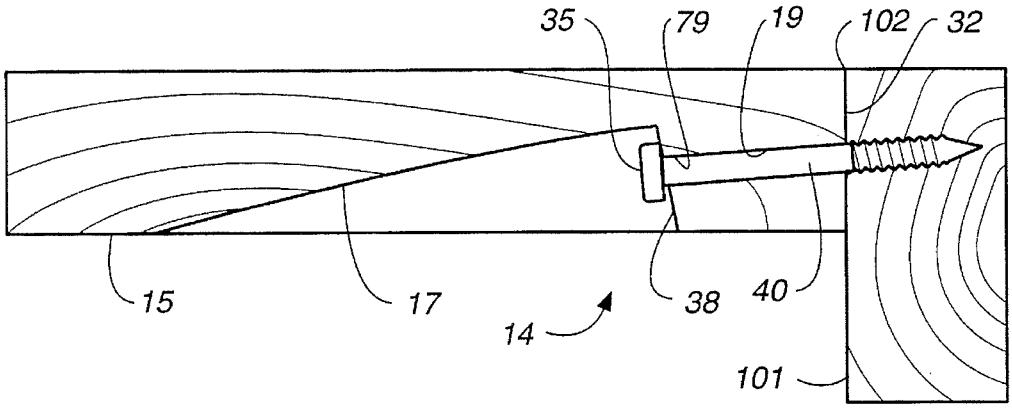
FIG. 2 is a side elevation view, in cross-section and schematic representation, of a prior art counterboring and drilling apparatus.

The tapered counterbore or recess 17 formed by router bit 36 terminates in a curved shoulder 38 (FIG. 5) which is generally perpendicular to surface 15 and approximately parallel and in spaced relation to edge 32 of the workpiece. Shoulder 38 provides a surface against which a fastener head 35 of a fastener 40 can bear against once a fastener receiving passage 19 is formed between shoulder 38 and edge 32 (FIG. 2).

To manually urge router assembly 34 between the stored and the routing position, a lever 64 is included pivotally mounted to frame 33 at lever pivot point 66 proximate a lower distal end thereof. An upper end of lever 64 extends up through an opposite upper slot 67 in casing 62 for manual manipulation of the router assembly from the stored position to the routing position. The operator, therefore, can use lever 64 to form counterbore 17 by pivoting the router support bracket and the router assembly clockwise, as shown from FIGS. 4 to 5, about router pivot point 49, 49'.

To movably couple lever 64 to router assembly 34, a linkage member 68 is provided having one end pivotally mounted to lever 64 at a central pivot point 69, and an opposite end pivotally mounted to a flange portion 71 of L-shaped member 53 of router support bracket 51 (FIGS. 4 and 7). Accordingly, as lever 64 is pivotally moved about lever pivot point 66 rearwardly along the path indicated by arrow 72 in FIG. 5, linkage member 68 pulls router support bracket 51 (and hence router assembly 34) about router pivot point 49, 49' from the stored to the routing position for contact with workpiece 13.

Importantly, biasing assembly 43 includes a router biasing device 73 which gravitationally biases router assembly 34 toward the stored position. After lever 64 has been manually moved to the routing position of FIG. 5, the router biasing device will automatically move or urge router assembly back to the stored position.

In accordance with the present invention, the combined centers of gravity (CG) of router assembly 34 and router support bracket 51 cooperate to urge or bias the router assembly and the support bracket toward the stored position (FIGS. 4 and 6). This is accomplished by positioning the CG above and to one side of the router pivot point 49, 49' (i.e., toward the stored position) so that the combined weight of router assembly 34 and router support bracket 51 are caused to pivot about router pivot point 49, 49' toward the stored position. It will be appreciated, however, that this combined weight must also overcome the opposing forces exerted by the weight of lever 64 and linkage member 68 which urge router assembly toward the routing position. Further, the biasing of the router assembly toward the stored position could be accomplished by springs or the like.

In the counterboring and drilling apparatus of the present invention, the apparatus further includes drill assembly 39 oriented with an axis of rotation 42 generally parallel to the direction of motion 76 (FIG. 6) of the drill assembly and generally perpendicular to the axis of rotation 37 of the router bit 34 when moved to the routing position (as represented by counterbore shoulder 38). Thus, drill assembly 39 includes a drill bit 41 mounted for movement in a direction of arrow 76 to drill passage 19. The drill bit is guided through drill bit opening 77 in casing wall or step 46 and into workpiece edge 32 where the drill bit drills through the workpiece to at least shoulder 38. Moreover, the depth from surface 15 at which drill bit 41 drills passage 19 into the workpiece is slightly less than or lower than the depth of counterbore 17 so that there will be a passage opening 79 (FIG. 2) of passage 19 in shoulder 38. This will allow the passage to communicate with the counterbore and provide room for fastener head 35 when the fastener 40 is inserted into passage 19.

Passage 19 can be at an angle of about zero (0) degrees to about ten (10) degrees to surface 15 to minimize shifting or dislocation of pieces when formed together. In the preferred embodiment, the oblique angle is about six (6) degrees. Additionally, passage 19 can have a diameter which substantially matches the fastener diameter to improve the shear characteristics of the resulting joint. Prior art systems have had to employ over-sized drill bits to withstand the bending stress, resulting from drilling at shallow angles.

FIGS. 4–7 indicate that drill assembly 39 is mounted to a guide assembly, generally designated 81, which is separate and apart from the pivotal movement of router support bracket 51, and is formed to linearly reciprocate drill assembly between a recessed position, (FIGS. 4 and 5), out of contact with workpiece 13, and a drilling position (FIG. 6), engaging the workpiece in a direction generally opposing the router bit to drill passage 19.

Figure 10:
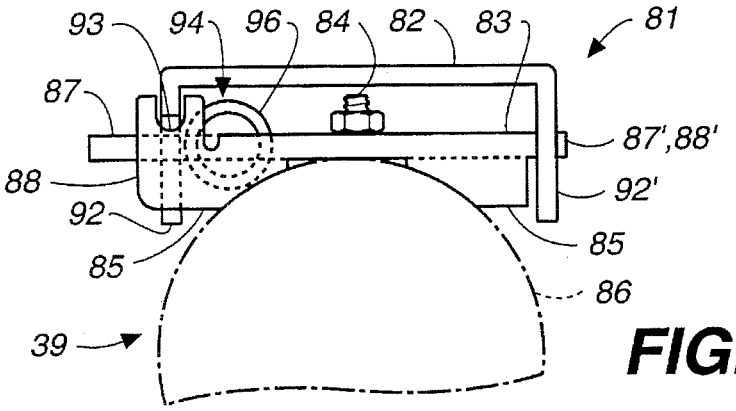
FIG. 10 is a rear elevation view of the guide assembly FIG. 8.
Figure 8:
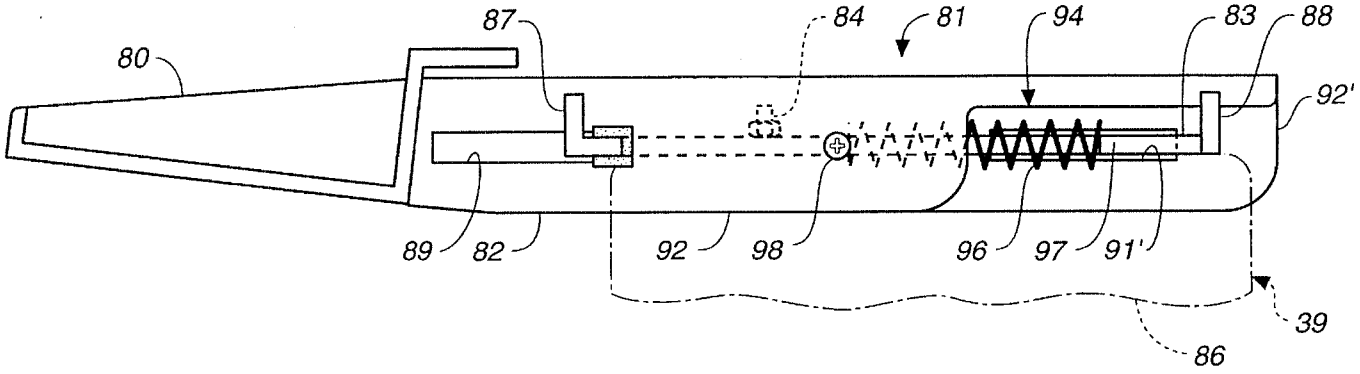
FIG. 8 is an enlarged side elevation view of a guide assembly of the apparatus of FIG. 3 illustrating the drilling assembly in broken lines.
Figure 9:
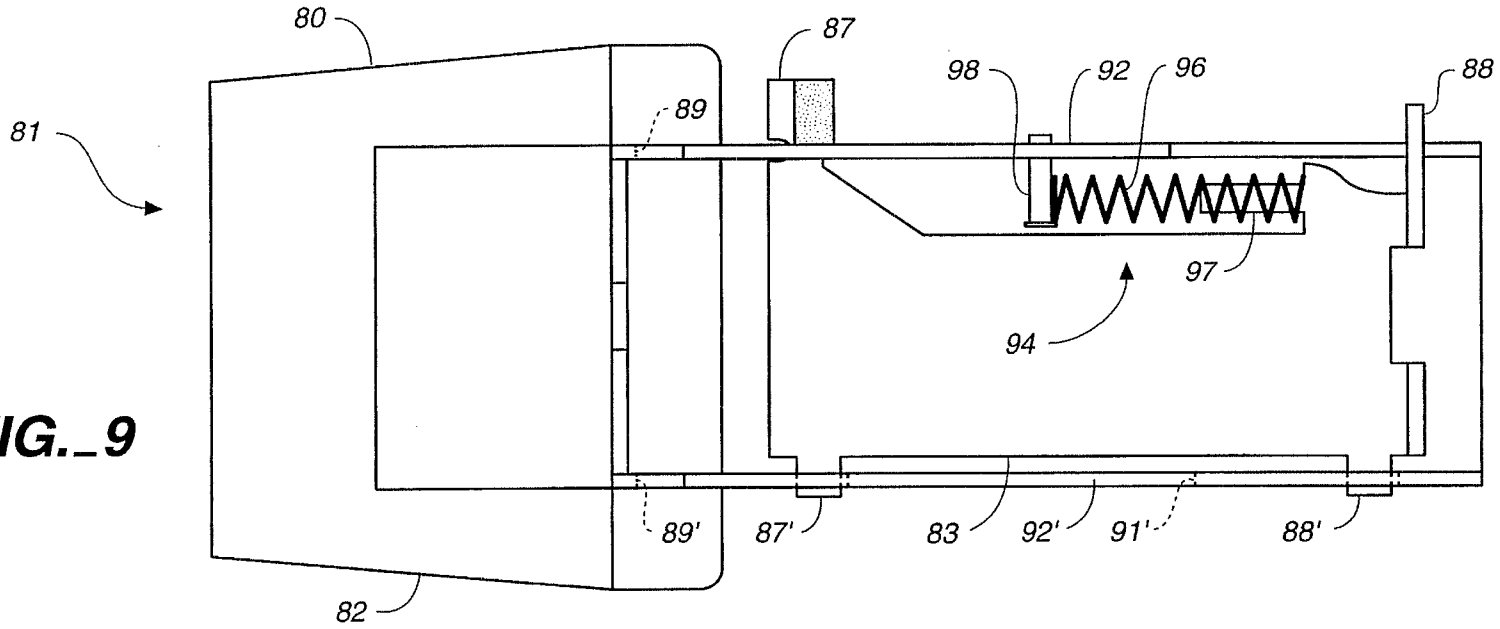
FIG. 9 is a bottom plan view of the guide assembly FIG. 8.

In the preferred form, guide assembly 81 includes a guide bracket 82 rigidly mounted to frame 33 at an upper portion of table 44 above step 46. Guide bracket 82, as shown in FIGS. 4–6, and in more detail at FIGS. 8–10, is generally elongated and provides a frontal portion 80 extending through an opening in casing wall 46. This frontal portion 80 of guide bracket 82 supports or mounts clamping device 47 thereto for engagement with workpiece 13.

Movably mounted to guide bracket 82 for linear reciprocation therealong is a carriage device 83 formed to support or suspend drill assembly 39 for movement between the recessed and the drilling position. Preferably, a bolt 84 extending upwardly from a drill body 86 of drill assembly 39 which protrudes through an aperture in carriage device 83 to releasably mount the drill assembly thereto. Further, a pair of ear portions 85, 85' extend downwardly from a rear portion of the carriage device for abutting contact with drill body 86. Drill assembly 39, hence, reciprocates with carriage device 83 for sliding linear movement along guide bracket 82 and generally parallel to the rotational axis 42 of drill bit 41.

Carriage device 83 preferably includes a pair of opposing guide flanges 87, 87' and 88' extending outwardly from the sides thereof. These flanges are formed to slidably matingly engage corresponding guide slots 89, 89' and 91' for cooperation therebetween to guide drill assembly 39 linearly between the recessed and the drilling position. As shown in FIGS. 4 and 10, guide slots 89, 89' and 91' extend longitudinally in the direction of the drill bit rotational axis 42 and are provided in opposing walls 92, 92' which extend downwardly from guide bracket 82. It will be understood, however, that many other linear guide assemblies could be employed.

One side of carriage device 83 includes a vertical guide flange 88 (FIG. 10) having a groove 93 formed and dimensioned for sliding receipt of a lower edge portion of side wall 92 therein as the carriage device moves between the recessed and the drilling position.

This vertically oriented guide flange 88 assures that the carriage device will not displace laterally or from side-to-side during linear movement of the carriage device between the recessed and the drilling position.

In accordance with the present invention, biasing assembly 43 includes a drill biasing device 94 which independently biases drill assembly 39 toward the recessed position. Moreover, as shown in FIG. 4, the drill biasing device 94 biases drill assembly 39 in a direction generally opposite the direction which router biasing device 73 biases the router assembly.

Drill biasing device 94 is preferably operably positioned between guide bracket 82 and carriage device 83 to urge the carriage device and its guide flanges 87, 87' and 88' linearly along guide slots 89, 89' and 91' respectively, toward the recessed position. FIGS. 8 and 9 further illustrate that drill biasing device 94 is preferably provided by a compression spring member 96 having one end mounted to a finger portion 97 of carriage device 83 extending therethrough, and an opposite end mounted or abutting to a pin member 98 coupled to side wall 92 of guide bracket 82. Accordingly, as carriage device 83 is moved forward toward the drilling position (FIG. 6), spring member 96 is compressed to increasingly oppose movement of the carriage device towards the drilling position. Upon release of the driving force (to be discussed below), spring member 96 pushes off against pin member 98 and carriage device 83 to independently urge drill assembly 39 back toward the recessed position.

Displacement of the carriage device relative the guide bracket between the recessed and the drilling position can be limited a number of different ways. Movement of the carriage device to the recessed position, however, is limited by one or more of the guide flanges 87, 87' and 88' abutting an end of the corresponding guide slots 89, 89' and 91'. Movement of the carriage device to the drilling position, in contrast, is preferably limited by abutment of lever 64 against an edge portion 95 (FIG. 3) of guide bracket 82 at one end of upper slot 67.

Lever 64 is also employed to manually urge carriage device 83 and drill assembly 39 toward the drilled position. FIGS. 6, 7 and 10 best illustrate that guide flange 87 extends outward from guide bracket 82 and well beyond side wall 92 by a sufficient amount to enable lever 64 to slidingly abut thereagainst when router assembly 34 is moved back to the drilling position.

As lever 64 engages flange 87 in a forward direction represented by arrow 99 of FIG. 6, guide bracket 82 is urged forwardly from the recessed position to the drilled position (FIG. 6) compressing spring member 96. Upon release of lever 64, spring member 96 urges the carriage device back towards the recessed position to draw drill bit 41 out of contact with workpiece.

In a neutral position (FIGS. 4 and 7) where both the router assembly 34 and the drilling assembly are situated in their respective stored position and recessed position, lever 64 is at rest and in gravitational abutment against guide flange 87. It will be appreciated, however, that the spring rate of spring member 96 is at least sufficient to overcome the associated gravitational forces acting thereon by lever 64, linkage member 68, router assembly 34 and router support bracket 51 which urge drill assembly toward the drilling position.

Accordingly, in operation, the operator can use lever 64 to form counterbore 17 by manually moving the lever in the direction of arrow 72 (FIG. 5). As lever 64 pivots about lever pivot point 66, linkage member 68 pulls router support bracket 51 rearwardly to pivot router assembly 34 about router pivot point 49, 49' (clockwise in FIG. 5) from the stored position to the routing position (in the direction of arrow 48). Router bit 36, hence, is mowed into contact with surface 15 of workpiece 13 to progressively cut tapered recess 17. The lever, on the other hand, separates from abutting contact with guide flange 87 so that drill assembly 39 is retained in the recessed position.

Upon release or removal of the manual force applied by the operator in the direction of arrow 72, the router biasing device (above-mentioned) urges both router assembly 34 and router support bracket 51 back toward the stored position (FIGS. 4 and 6). More specifically, the combined weight of the router assembly and the router support bracket gravitationally cause the same to rotate counter-clockwise about router pivot point 49, 49'. Lever 64 then abuts guide flange 87 once the neutral position is reached.

Manual manipulation of lever 64 forwardly in the direction of arrow 99 (FIG. 6) will move guide flange 87 slidingly and axially along lever 64. Subsequently, carriage device 83 and drill assembly 39 are urged forwardly compressing spring member 96 between finger portion 97 and pin member 98. Drill assembly 39, hence, is moved from the recessed position to the drilling position where drill bit. 41 contacts workpiece 13 to drill passage 19. As shown in FIG. 6, router assembly 34 is maintained in the stored position, out of contact with workpiece 13.

Upon release of lever 64, spring member 96 urges drill assembly 39 back toward the recessed position which further causes lever 64 to be moved back to the neutral position. Movement of carriage device 83 is stopped when one or all of the guide flanges 87, 87' and 88' abuts against one end of slots 89, 89' and 91' in the recessed position.

It will be appreciated that passage 19 may first be formed followed by the cut of counterbore 17 without departing from the true spirit and nature of the present invention.

In the guide assembly and drill assembly arrangement of the present invention, the linear displacement of the drill assembly need only be approximately the distance between the workpiece edge 32 and shoulder 38 of counterbore 17. Hence, the casing or housing depth (front to rear) can be minimized unlike U.S. Pat. No. 4,603,719. Further, this feature, along with the reduced height of the casing resulting from the short pivotal radius of the router bit provides a relatively compact design suitable for portability, storage and tabletop operation.

As will be understood, movement of support bracket 51 carriage device 83, and clamping device 47 also could be automated through the use of a mechanical, pneumatic or hydraulic actuator assembly (not shown). Such automation of the apparatus is particularly desirable when multiple counterboring and passage drilling assemblies are ganged together for production runs.

The resultant workpiece produced by the apparatus of the present invention is seen in FIG. 2. Once the counterbore and fastener receiving passage are formed, the workpiece edge 32 can be abutted up against a second member 101 and a fastener, for example a screw or fastener 40, can be used to join workpiece 13 to second member 101. Second member 101 is perpendicularly oriented to workpiece 13, but it will be understood that the second member can also lie in the same plane as workpiece 13, for example, in the formation of a face frame. Similarly, second member 101 can terminate in an edge at 102 which is flush with the top surface of workpiece 13 so as to form a corner joint.

It is an important feature of the apparatus and method of the present invention that it permits an end of fastener 40 to extend very close to the outside surface of the second member for full engagement of the fastener threads. This can only be accomplished if the distance between shoulder 38 and wedge 32 can be carefully controlled. The use of a router oriented transverse to the workpiece in order to form counterbore 17 allows a high degree of accuracy in controlling the distance between edge 32 and shoulder 38. Accordingly, fastener 40 will reproducibly extend into second member 101 a distance which can be very close to but not extend through surface 15. This distance can be controlled by adjusting the travel of lever 64 in the direction of arrow 72 which limits the pivotal movement of router bit 36.

Forward linear displacement of carriage device 83 is less critical since drill bit 41 can drill through its counterbore recess. As mentioned above, the forward travel of carriage device 83 relative guide bracket 82 is limited through the abutment of lever 64 against edge portion 95 (FIG. 3) of guide bracket 82 positioned at one end of upper slot 67.

The method of forming a counterbore and passage of the present invention can be performed advancing router assembly 34 from a stored position, out of contact with workpiece 13, to a routing position, contacting the workpiece with a router bit 36 along a path to progressively cut an inwardly tapering counterbore 17 in surface 15 terminating in a transverse shoulder 38; and advancing drill assembly 39 from a recessed position, out of contact with workpiece 13, to a drilling position, contacting the workpiece from edge 32 inwardly until passage 19 extends to a position which will communicate with counterbore 17. The method further includes the step of independently biasing router assembly 34 and drill assembly 39 in generally opposite directions toward the stored position and the recessed position, respectively, to maintain router bit 36 and drill bit 41 out of engaging contact with one another.

The advancing steps are accomplished by sequentially reciprocating router assembly 34 and drill assembly 39 independently. Further the reciprocating step for drill assembly 39 is accomplished by linearly sliding it along guide assembly 81. Likewise, the reciprocating step for router assembly 34 is accomplished by pivoting it about pivotal axis 49, 49'. Finally, the biasing step for router assembly 34 is accomplished by positioning pivotal axis 49, 49' at a location below a center of gravity of router assembly 34 such that it is gravity biased toward the stored position.

The method and apparatus of the present invention can be used to form a passage and counterbore in relatively hard materials such as particle board, hardboard and high-pressure plastic laminates. Moreover, extremely accurate passage and counterbore cuts can be made in plastics having low friction surfaces. Additionally, the low or shallow angle of the fastener receiving passage allows a minimal clamping structure to be used to control shifting or the dislocation of the parts being fastened.

What is claimed is:

1. An apparatus for forming an obliquely oriented counterbore in a surface of a workpiece and a fastener receiving passage proximate an edge of said workpiece, said apparatus comprising:

a support frame;

a router assembly having a router bit, and movably mounted to said frame and oriented with the router bit rotational axis generally perpendicular to the direction of motion of said router assembly, said router assembly being mounted for arcuate movement between a stored position, out of contact with said workpiece, and a routing position, contacting said workpiece along a progressively inwardly path to cut a tapering recess in said surface terminating in a shoulder transverse to said surface proximate and in spaced relation to said edge to form said obliquely oriented counterbore;

a drill assembly having a drill bit, and being movably mounted to said frame and oriented with the drill bit rotational axis generally perpendicular to the router bit rotation axis when said router bit is situated in said routing position, said drill assembly being mounted for linear movement between a recessed position, out of contact with said workpiece, and a drilling position, engaging said workpiece in a direction generally opposing said router bit to drill said passage from said edge into said workpiece a sufficient distance causing said passage to communicate with said counterbore;

a biasing assembly independently biasing said router assembly and said drill assembly in generally opposite directions toward said stored position and said recessed position, respectively, to maintain said router bit and said drill bit out of engaging contact with one another.

2. The apparatus as defined in claim 1 further including:

a clamping device supporting said workpiece to said frame in a position for formation of said counterbore and said passage.

3. The apparatus as defined in claim 1 further including:

a guide assembly coupled between said frame and said drill assembly providing guided linear movement of said drill bit between said stored position and said drilling position.

4. The apparatus as defined in claim 3 wherein, said guide assembly includes a guide bracket rigidly mounted to said frame, and a carriage device supporting said drill assembly and slidably cooperating with said guide bracket to provide said guided linear movement.

5. The apparatus as defined in claim 4 wherein, said guide bracket includes a pair of opposed slots extending in the direction substantially parallel to said guided linear movement, and said carriage device includes a pair of guide flanges formed for sliding receipt in said slots.

6. The apparatus as defined in claim 4 further including:

a clamping device rigidly mounted to said guide bracket for supporting said workpiece to said frame in a position for formation of said counterbore and said passage.

7. The apparatus as defined in claim 4 wherein, said biasing assembly includes a drill biasing device positioned between said guide bracket and said carriage device for biasing said drill assembly toward said stored position.

8. The apparatus as defined in claim 7 wherein, said drill biasing device is provided by a compression spring.

9. The apparatus as defined in claim 1 wherein, said router assembly is pivotally mounted to said frame for said arcuate movement of said router bit between said stored position and said routing position.

10. The apparatus as defined in claim 9 wherein, the radius of said arcuate movement of said router bit is substantially no more than the length of said router assembly.

11. The apparatus as defined in claim 1 wherein, said biasing assembly includes a router support bracket formed for rigid mounting of said router assembly thereto and pivotally mounted about a bracket axis to said frame at a location below a combined center of gravity of said router assembly and said support bracket such that said router assembly is gravity biased toward said stored position.

12. The apparatus as defined in claim 11 further including:

a lever pivotally mounted to said frame proximate a lower portion thereof, and a linkage member having one end pivotally mounted to said support bracket above said bracket axis, and an opposite end pivotally mounted to said lever such that selective manual movement of said lever causes said router assembly to move between said stored position and said routing position.

13. The apparatus as defined in claim 12 further including:

a guide assembly coupled between said frame and said drill assembly providing guided linear movement of said drill bit between said stored position and said drilling position.

14. The apparatus as defined in claim 13 wherein, said guide assembly includes a guide bracket rigidly mounted to said frame, and a carriage device supporting said drill assembly and slidably cooperating with said guide bracket to provide said guided linear movement.

15. The apparatus as defined in claim 14 wherein, said lever slidably contacts said carriage device when said router assembly is proximate said stored position to urge said drill assembly from said recessed position to said drilling position.

16. In an apparatus for forming an obliquely oriented tapered recess in a surface of a workpiece terminating in a shoulder transverse to said surface, and a fastener receiving passage extending from proximate an edge of said workpiece a sufficient distance to communicate with said tapered recess, said apparatus including a support frame, a router assembly having a router bit and movably mounted to said frame, and oriented with the router bit rotational axis generally perpendicular to the direction of motion of said router assembly, and a drill assembly having a drill bit and being movably mounted to said frame, and oriented with the drill bit rotational axis generally perpendicular to said transverse shoulder, the improvement comprising:

said router assembly being mounted for arcuate movement between a stored position, out of contact with said workpiece, and a routing position, contacting said workpiece along a progressively inwardly path to cut said tapering recess;

said drill assembly being mounted for linear movement between a recessed position, out of contact with said workpiece, and a drilling position, engaging said workpiece in a direction generally opposing said router bit to drill said passage; and a biasing assembly independently biasing said router assembly and said drill assembly in generally opposite directions toward said stored position and said recessed position, respectively, to maintain said router bit and said drill bit out of engaging contact with one another.

17. The apparatus as defined in claim 16 further including:

a guide assembly coupled between said frame and said drill assembly providing guided linear movement of said drill bit between said stored position and said drilling position.

18. The apparatus as defined in claim 17 wherein, said guide assembly includes a guide bracket rigidly mounted to said frame, and a carriage device supporting said drill assembly and slidably cooperating with said guide bracket to provide said guided linear movement.

19. The apparatus as defined in claim 18 wherein, said biasing assembly includes a drill biasing device positioned between said guide bracket and said carriage device for biasing said drill assembly toward said stored position.

20. The apparatus as defined in claim 16 wherein, said router assembly is pivotally mounted to said frame for said arcuate movement of said router bit between said stored position and said routing position.

21. The apparatus as defined in claim 20 wherein, the radius of said arcuate movement of said router bit is substantially no more than the length of said router assembly.

22. The apparatus as defined in claim 16 wherein, said biasing assembly includes a router support bracket formed for rigid mounting of said router assembly thereto and pivotally mounted about a bracket axis to said frame at a location below a combined center of gravity of said router assembly and said support bracket such that said router assembly is gravity biased toward said stored position.

23. The apparatus as defined in claim 22 further including:

a lever pivotally mounted to said frame proximate a lower portion thereof, and a linkage member having one end pivotally mounted to said support bracket above said bracket axis, and an opposite end pivotally mounted to said lever such that selective manual movement of said lever causes said router assembly to move between said stored position and said routing position.

24. A method of forming all obliquely oriented counterbore in a surface proximate an edge of a workpiece and a connecting fastener receiving passage between said counterbore and said edge comprising the steps of:

advancing a router assembly from a stored position, out of contact with said workpiece, to a routing position, contacting said workpiece with a router bit of said router assembly oriented with the router bit rotational axis transverse to said surface in which said counterbore is to be formed and along a path to progressively cut an inwardly tapering counterbore in said surface terminating in a transverse shoulder;

advancing a drill assembly from a recessed position, out of contact with said workpiece, to a drilling position, contacting said workpiece from said edge inwardly until said passage extends to a position which will communicate with said counterbore;

independently biasing said router assembly and said drill assembly in generally opposite directions toward said stored position and said recessed position, respectively, to maintain said router bit and said drill bit out of engaging contact with one another.

25. The method as defined in claim 24 wherein, said advancing steps are accomplished by sequentially reciprocating said router assembly and said drill assembly independently.

26. The method as defined in claim 25 wherein, said reciprocating step for said drill assembly is accomplished by linearly sliding said drill assembly along a guide assembly.

27. The method as defined in claim 25 wherein, said reciprocating step for said router assembly is accomplished by pivoting said router assembly about a pivotal axis.

28. The method as defined in claim 27 wherein, said biasing step for said router assembly is accomplished by positioning said pivotal axis at location below a center of gravity of said router assembly such that said router assembly is gravity biased toward said stored position.

* * * * *